US010442072B2

(12) United States Patent
Kemp

(10) Patent No.: US 10,442,072 B2
(45) **Date of Patent: *Oct. 15, 2019**

(54) MULTIFUNCTIONAL BACK TOOL

(71) Applicant: David Kemp, Chicago, IL (US)

(72) Inventor: David Kemp, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/252,631

(22) Filed: Jan. 19, 2019

(65) Prior Publication Data

US 2019/0152042 A1 May 23, 2019

Related U.S. Application Data

(63) Continuation of application No. 15/787,567, filed on Oct. 18, 2017, now Pat. No. 10,279,462.

(51) Int. Cl.

| | |
|---|---|
| ***B25G 1/04*** | (2006.01) |
| ***A47K 7/02*** | (2006.01) |
| ***A61H 37/00*** | (2006.01) |
| *A45D 34/00* | (2006.01) |

(52) U.S. Cl.

CPC ..... *B25G 1/04* (2013.01); *A47K 7/022* (2013.01); *A47K 7/028* (2013.01); *A61H 37/00* (2013.01); *A45D 2034/002* (2013.01)

(58) Field of Classification Search

CPC ..... A61H 7/005; A61H 7/003; A61H 37/00; D06F 57/04; B25J 1/04; A47F 5/0892; B25G 1/04; A47K 7/022; A47K 7/028; A45D 2034/002

See application file for complete search history.

(56) References Cited

U.S. PATENT DOCUMENTS

| | | | | |
|---|---|---|---|---|
| 2,639,930 | A | 5/1953 | Thornton | |
| D391,706 | S | 3/1998 | Malcolm | |
| 5,904,661 | A * | 5/1999 | Bonz | A61H 7/005 601/101 |
| 5,913,739 | A | 6/1999 | Brenneisen | |
| D461,009 | S * | 7/2002 | Viner | D24/214 |
| 6,883,994 | B1 * | 4/2005 | Grogg | A47K 7/03 401/196 |
| 6,994,680 | B1 * | 2/2006 | Aponte | A61H 7/005 601/136 |

(Continued)

FOREIGN PATENT DOCUMENTS

| | | |
|---|---|---|
| CA | 2257114 | * 12/1998 |

OTHER PUBLICATIONS

U.S. Appl. No. 15/787,567, filed Oct. 18, 2017, Kemp, David.

(Continued)

*Primary Examiner* — Stephen A Vu

(74) *Attorney, Agent, or Firm* — Foley & Lardner LLP

(57) ABSTRACT

A personal care product includes an elbow, a handle, an arm, a first personal care attachment, and a second personal care attachment. The elbow has a first end extending in a first direction and a second end extending in a second direction that is non-parallel to the first direction. The handle is coupled to the first end of the elbow such that the handle extends in the first direction. The arm is coupled to the second end of the elbow such that the arm extends in the second direction. The first personal care attachment is detachably coupled to the arm. The second personal care attachment is interchangeable with the first personal care attachment.

17 Claims, 3 Drawing Sheets

(56) References Cited

U.S. PATENT DOCUMENTS

| | | | | |
|---|---|---|---|---|
| 8,020,716 | B2 | 9/2011 | Vitale | |
| 9,168,196 | B2 * | 10/2015 | Dagan | A61H 7/003 |
| 2004/0163215 | A1 | 8/2004 | Wang | |
| 2007/0093736 | A1 * | 4/2007 | Hebert | A61H 7/003 601/137 |
| 2007/0287938 | A1 * | 12/2007 | Shields | A61H 15/0092 601/15 |
| 2016/0114477 | A1 | 4/2016 | Saccoccio et al. | |
| 2017/0239531 | A1 | 8/2017 | Olivieri | |

OTHER PUBLICATIONS

Final Office Action in U.S. Appl. No. 15/787,567 dated Nov. 5, 2018.
Notice of Allowance in U.S. Appl. No. 15/787,567 dated Nov. 21, 2018.
U.S. Office Action in U.S. Appl. No. 15/787,567 dated May 18, 2018.

* cited by examiner

MULTIFUNCTIONAL BACK TOOL

CROSS-REFERENCE TO RELATED PATENT APPLICATIONS

The present application is a continuation of U.S. patent application Ser. No. 15/787,567, filed Oct. 18, 2017, which is incorporated herein by reference in its entirety.

BACKGROUND

The present application relates to a multifunctional back tool and, in particular, to an adjustable multifunctional back tool for accessing a user's back.

Cleaning devices may be used to apply soaps, lotions, and other cleaners and cosmetic preparations to areas that are normally inaccessible or difficult to reach using the user's hands, such as the back of a human body. Moreover, accessibility becomes even more difficult for disabled individuals who may not have full range of motion. Conventional cleaning devices often use a single-piece, straight-edge construction that requires the user to fully extend at least a portion of the user's arms in order to reach the more difficult sections of the user's back. Other devices are limited by engineering design, with the device being constrained by an end head attachment permanently affixed to a utility end of the device. Yet other devices are often insufficient for gentle and conformal cleansing and/or application (e.g., lotions, cosmetics, etc.) processes since they are unable to provide sufficient leverage for the user in either an up-and-down or sideways motion.

A need exists for improved technology, including an adjustable multifunctional back tool for accessing parts of a human body.

SUMMARY

In certain embodiments, a multifunctional back tool includes a handle; a mounting elbow including a first end and a second end; a first adjustment brace coupled to the first end of the mounting elbow, the first adjustment brace adjustably coupled to the handle by selective engagement between a first detent and a first plurality of slots; an arm; and a second adjustment brace coupled to the second end of the mounting elbow, the second adjustment brace adjustably coupled to the arm by selective engagement between a second detent and a second plurality of slots; wherein the handle is adjustable between a plurality of discrete positions relative to the first adjustment brace, and wherein the arm is adjustable between a plurality of discrete positions relative to the second adjustment brace.

In one aspect, the multifunctional back tool further includes a detachable utility head connected with a terminal elbow.

In one aspect, the utility head comprises at least one of a scratcher head, a washcloth, a lotion applicator, a loofah, a bath pouf, a massager, a heater, or a combination thereof.

In one aspect, the utility head is connected with the terminal elbow via at least one of a nut/bolt configuration, magnetically, hook and loop fastener (e.g., VELCRO), threading, adhesive tape, suction cups, snap-on cartridges, sliding grooves, or a combination thereof.

In one aspect, the utility head and the terminal elbow are formed from a single piece of construction.

In one aspect, the utility head is a rotatable about an intervening joint positioned between the utility head and the terminal elbow.

In one aspect, the terminal elbow is connected with the arm via at least one of a nut/bolt configuration, magnetically, hook and loop fastener (e.g., VELCRO), threading, adhesive tape, suction cups, snap-on cartridges, sliding grooves, or a combination thereof.

In one aspect, the terminal elbow and the arm are formed from a single piece of construction.

In one aspect, the handle comprises a first locking mechanism configured to lock into the first plurality of slots and/or wherein the arm comprises a second locking mechanism configured to lock into the second plurality of slots.

In one aspect, the first plurality of slots and/or the second plurality of slots are separated by a length in a range of 0.5 inch to 1.5 inches.

In one aspect, the first adjustment brace is coupled to the first end and/or the second adjustment brace is coupled to the second end via at least one of a nut/bolt configuration, a slot/locking mechanism, an adhesive, a sealant, a caulk, a putty, an epoxy, magnetically, or a combination thereof.

In one aspect, the first adjustment brace, the second adjustment brace, and the mounting elbow are formed from a single piece of construction.

In one aspect, the handle includes a non-slip, safety grip comprising at least one of tape, friction fabric, foam, or a combination thereof.

In one aspect, a cross-sectional shape of the multifunctional back tool in an assembled configuration is selected from the group consisting of circular, oval, square, rectangular, and diamond.

In certain embodiments, a multifunctional tool for reaching a back of a user, the multifunctional tool includes a mounting elbow including a first end and a second end; an adjustable handle slidably coupled to the first end of the mounting elbow, the adjustable handle having a grip for the user; an adjustable arm slidably coupled to the second end of the mounting elbow; a utility head removably coupled to the adjustable arm and configured to engage the back of the user by manipulation of the adjustable handle by the user.

In one aspect, the multifunctional tool further includes a terminal elbow, the terminal elbow having a first member coupled to the adjustable arm and a second member extending parallel with the adjustable handle.

In one aspect, the utility head is coupled to the second member of the terminal elbow.

In one aspect, the utility head is coupled to the terminal elbow by at least one of a nut/bolt configuration, magnetically, hook and loop fastener (e.g., VELCRO), threading, adhesive tape, suction cups, snap-on cartridges, sliding grooves, or a combination thereof.

In one aspect, the multifunctional tool further includes a first detent configured to releasably engage one of a plurality of first apertures to lock the adjustable handle to the mounting elbow in one of a plurality of discrete positions, and a second detent configured to releasably engage one of a plurality of second apertures to lock the adjustable arm to the mounting elbow in one of a plurality of discrete positions.

In one aspect, the utility head is configured for rotation relative to the adjustable arm.

These and other advantageous features will become apparent to those reviewing the disclosure and drawings.

DETAILED DESCRIPTION

Figure 1:
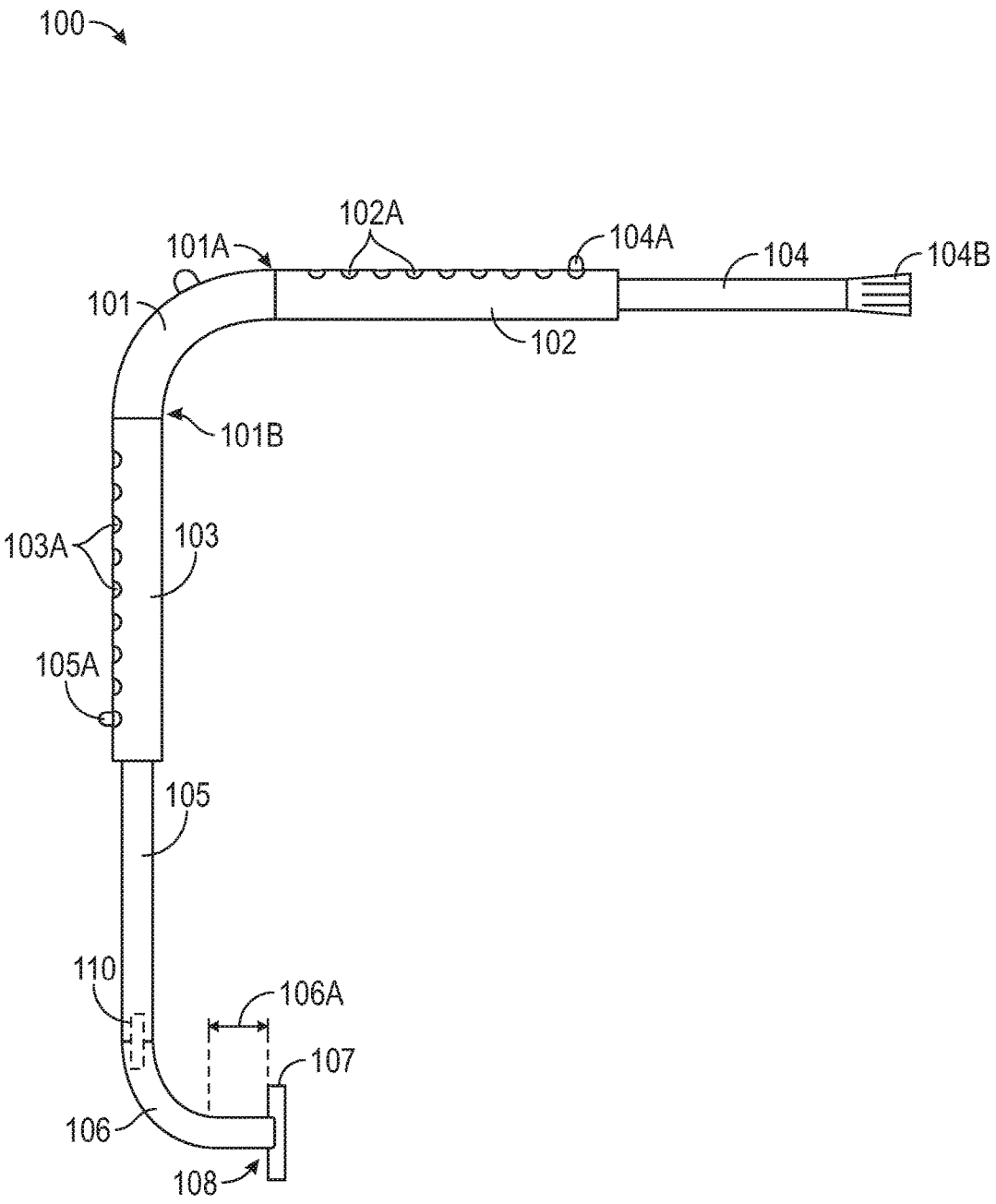
FIG. 1 illustrates an exemplary adjustable multifunctional back tool according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

The present disclosure describes a novel multifunctional back tool that allows a user to cleanse, scratch, massage, moisturize, or heat treat the user's back with significantly less stress or strain on the user's arms. For example, the back tool may be held during use such that a portion of the user's arm from the shoulder to the elbow is substantially horizontal. In other words, the back tool is held from the handle at about the user's eye level whereby a utility head of the back tool contacts the user's back. The utility head includes at least one of a scratcher head, a washcloth, a lotion applicator, a loofah, a bath pouf, a massager, a heater, or a combination thereof. In this manner, the user is allowed to effectively perform the predetermined function without straining the shoulder of the user. This is particularly helpful for users with limited flexibility or have a disability that inhibits access to his/her back.

FIG. 1 illustrates an exemplary adjustable multifunctional back tool according to one implementation. A multifunctional back tool 100 includes a mounting elbow 101 which has a first end 101*a* and a second end 101*b*. The first end 101*a* is coupled to a first adjustment brace 102 and the second end 101*b* is coupled to a second adjustment brace 103. The first adjustment brace 102 and the second adjustment brace 103 may be coupled to the first end 101*a* and the second end 101*b*, respectively, by at least one of a nut/bolt configuration, a slot/locking mechanism, an adhesive, a sealant, a caulk, a putty, an epoxy, magnetically, or a combination thereof. In one embodiment, the mounting elbow 101, first adjustment brace 102, and the second adjustment brace 103 are formed from a single piece of construction.

Figure 3:
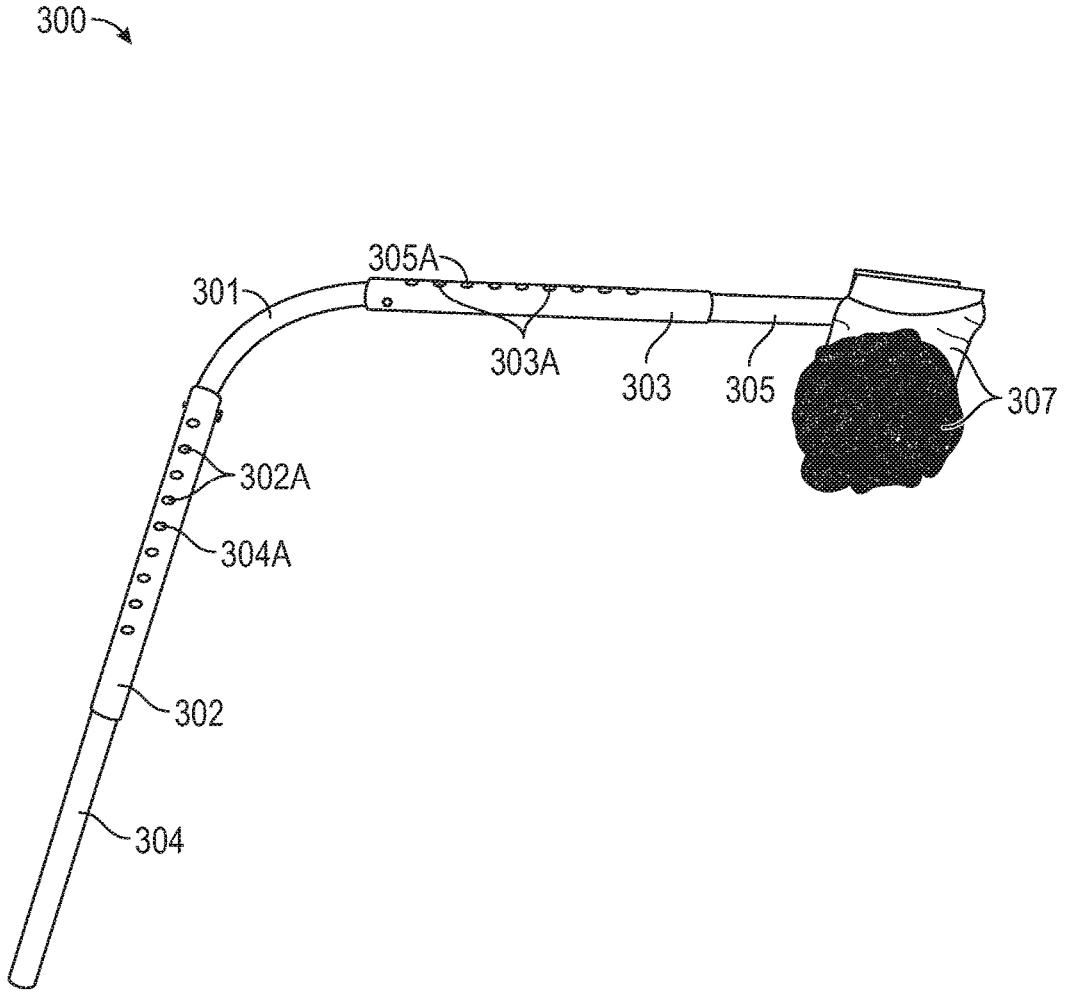
FIG. 3 illustrates an exemplary adjustable multifunctional back tool according to one embodiment.

In one embodiment the mounting elbow 101, first adjustment brace 102, and the second adjustment brace 103 all have a circular cross-section such that the diameter of the mounting elbow 101 cross-section is smaller than the diameter of the cross-sections of the first adjustment brace 102 and/or the second adjustment brace 103. In such a configuration, the first adjustment brace 102 and/or the second adjustment brace 103 are hollow and function as receptacles capable of receiving other components of the back tool within the hollow space, such as the mounting elbow 101, adjustable handle 104, and adjustable arm 105 (FIG. 3). The back tool may be similarly configured using other cross-sectional shapes such as oval, square, rectangular, diamond, and the like. The adjustable handle 104 includes a non-slip, resistance-enhancing safety grip 104*b* comprising at least one of tape, friction fabric, foam, or a combination thereof.

The first adjustment brace 102 includes a first plurality of slots 102*a* configured to attach with an adjustable handle 104 and the second adjustment brace 103 includes a second plurality of slots 103*a* configured to attach with an adjustable arm 105 in a variety of discrete positions. The slots 102*a* and/or slots 103*a* may be apertures, holes, bores, openings, or the like. The first plurality of slots 102*a* and/or the second plurality of slots 103*a* may be independently positioned based on the configuration of the adjustable handle 104 attaching to the first adjustment brace 102 and the configuration of the adjustable arm 105 attaching to the second adjustment brace 103. For example, in one embodiment, the first plurality of slots 102*a* and/or the second plurality of slots 103*a* are independently engineered to be separated by a length in a range of 0.5 inch to 1.5 inches.

The adjustable handle 104 comprises a first locking mechanism 104*a* configured to lock into the first plurality of slots 102*a* and/or the adjustable arm 105 comprises a second locking mechanism 105*a* configured to lock into the second plurality of slots 103*a*. In one embodiment, the first locking mechanism 104*a* and the second locking mechanism 105*a* may be a push-button ball bearing (e.g., detent, or other biased interference member) that engages slots 102*a* and 103*a* whereby the user presses and holds down the ball bearing causing it to temporarily submerge into (e.g., disengage, unlock, etc.) the adjustable handle 104 and adjustable arm 105, respectively, as the user inserts the adjustable handle 104 and adjustable arm 105 into the first adjustment brace 102 and second adjustment brace 103, respectively. Once the adjustable handle 104 and adjustable arm 105 are sufficiently held by the first adjustment brace 102 and second adjustment brace 103, respectively, the user may release the ball bearing and continue to slide the adjustable handle 104 and adjustable arm 105 until a first of the first plurality of slots 102*a* and a first of the second plurality of slots 103*a* is reached. The spring-loaded ball bearing will automatically reemerge from the submerged position and lock (engage, etc.) into the first of the first plurality of slots 102*a* and the first of the second plurality of slots 103*a*. The user may then continue to readjust the position at which the locking mechanism is configured by reiterating the pressing-holding-sliding procedure to achieve a customized back tool configuration for the user. The first locking mechanism 104*a* and the second locking mechanism 105*a* may be independently altered and moved based on the desired configuration of the user.

Figure 2:
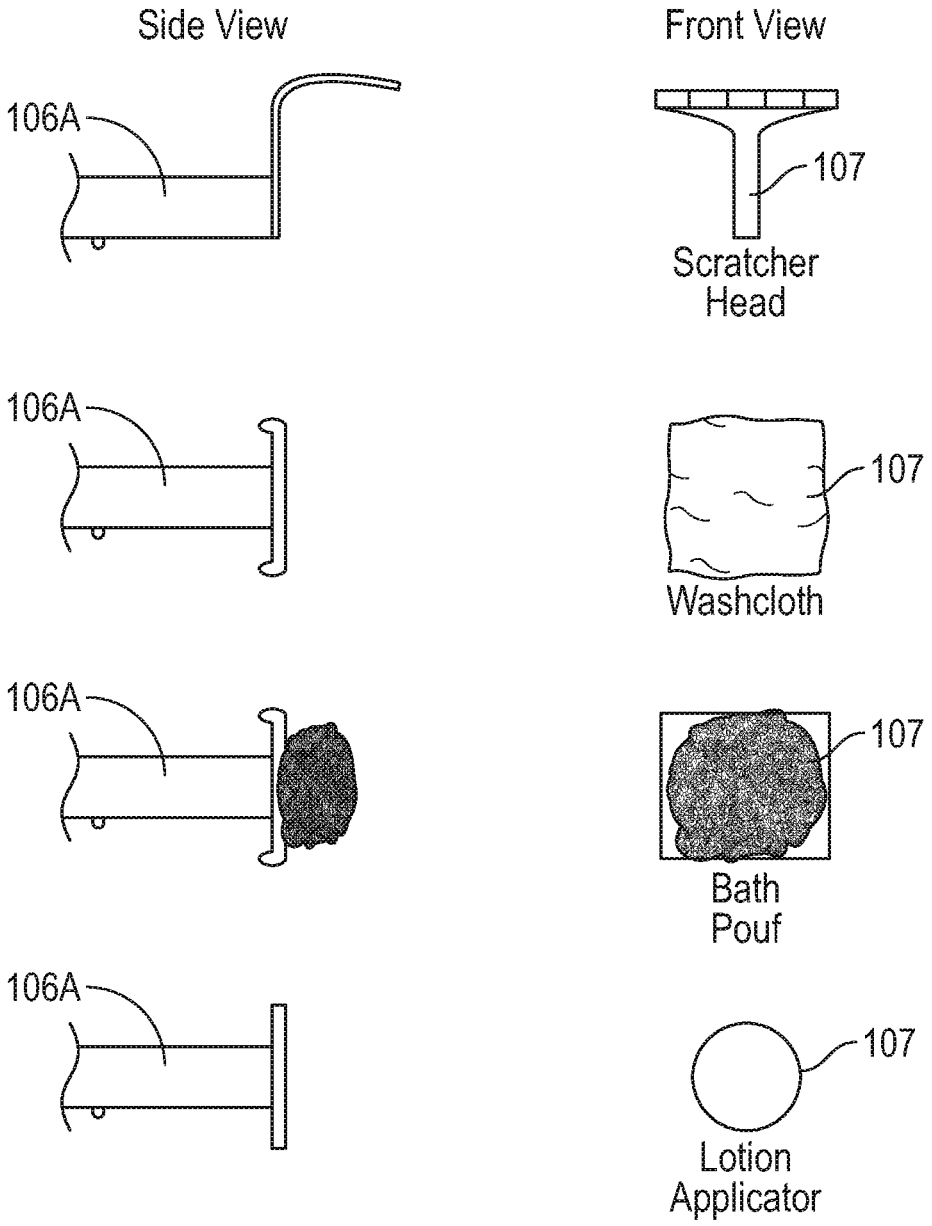
FIG. 2 illustrates exemplary utility heads attachable to an adjustable arm.

A detachable utility head 107 is connected with a terminal elbow 106 of the back tool 100 via at least one of a nut/bolt configuration, magnetically, Velcro, threading, adhesive tape, suction cups, snap-on cartridges, sliding grooves, or a combination thereof. In one embodiment, the utility head 107 and the terminal elbow 106 are formed from a single piece of construction. The utility head 107 comprises at least one of a scratcher head, a washcloth, a lotion applicator, a loofah, a bath pouf, a massager, a heater, or a combination thereof. FIG. 2 illustrates a side view and a front view of exemplary utility heads 107 that may be attached to the terminal elbow 106.

The terminal elbow 106 is connected with the adjustable arm 105 by a coupler 110 that includes at least one of a nut/bolt configuration, magnets, Velcro, threading, adhesive tape, suction cups, snap-on cartridges, sliding grooves, or a combination thereof. In one embodiment, the terminal elbow 106 and the adjustable arm 105 are formed from a single piece of construction. A lateral portion 106*a* of the terminal elbow 106 may be adjusted telescopically to allow for lateral movement of the utility head 107 in a direction perpendicular to movement of the adjustable arm 105.

In one embodiment, the utility head 107 is connected with the terminal elbow 106 via an intervening joint 108. The utility head 107 may be rotatable about the joint 108 (e.g., swivel, bearing, hinge, etc.) to allow for flexibility in accessing hard-to-reach portions of the user's back. In one implementation, the joint 108 is connected to terminal elbow 106 via a ball-cup socket whereby a ball bearing is inserted into a receiving cup that allows for 360 degree rotation of the utility head 107. In one example, the ball bearing is a portion of the terminal elbow 106 and the receiving cup is the joint 108. In another example, the ball bearing is the joint 108 and the receiving cup is a portion of the terminal elbow 106.

Each component of the multifunctional back tool 100 may be fabricated with lightweight and durable materials of construction such as metals and their composites (e.g., titanium, aluminum, magnesium, etc.), carbon fiber, polymers and their blends (e.g., polyamide, polystyrene, polyvinylchloride, polymethylmethacrylate, polycarbonate, polyoxymethylene, polyester, polyphenylene sulfide, polyethersulfone, polyalkyleneisophthalate, polyarylate, polyetheretherketone, polyetherimide, polyimide, polytetrafluoroethylene, liquid crystalline polymers, etc.), nanostructured ceramics, or combinations thereof.

Exemplary Embodiment

FIG. 3 illustrates an exemplary adjustable multifunctional back tool according to one embodiment. A multifunctional back tool 300 includes a mounting elbow 301 having a first end and a second end (not shown) coupled to a first adjustment brace 302 and a second adjustment brace 303, respectively. The mounting elbow 301, first adjustment brace 302, and second adjustment brace 303 have circular cross-sections such that the diameter of the mounting elbow 301 cross-section is smaller than the diameter of the cross-sections of the first adjustment brace 302 and the second adjustment brace 303. The first adjustment brace 302 and the second adjustment brace 303 are hollow and function as receptacles that receive the mounting elbow 301, adjustable handle 304, and adjustable arm 305 within the hollow space. The mounting elbow 301, first adjustment brace 302, and the second adjustment brace 303 are formed from a single piece of construction.

The first adjustment brace 302 includes a first plurality of slots 302*a* configured to attach with an adjustable handle 304 and the second adjustment brace 303 includes a second plurality of slots 303*a* configured to attach with an adjustable arm 305. The first plurality of slots 302*a* and the second plurality of slots 303*a* are positioned to be separated from each other by approximately one inch.

The adjustable handle 304 comprises a first locking mechanism 304*a* configured to lock into the first plurality of slots 302*a* and the adjustable arm 305 comprises a second locking mechanism 305*a* configured to lock into the second plurality of slots 303*a*. The first locking mechanism 304*a* and the second locking mechanism 305*a* utilize the push-button ball bearing locking technique as described above. In preparation for use, the user presses and holds down the ball bearing of the adjustable handle 304 and adjustable arm 305, inserts the adjustable handle 304 and adjustable arm 305 into the first adjustment brace 302 and second adjustment brace 303, respectively, and optimizes the locking position of the ball bearing to achieve a customized back tool configuration for the user. The first locking mechanism 304*a* and the second locking mechanism 305*a* may be independently altered and moved based on the desired configuration of the user. The terminal elbow (not shown) and the adjustable arm 305 are formed from a single piece of construction.

A detachable utility head 307 comprises a bath pouf and is connected to a lateral portion of the terminal elbow (not shown) by a releasable fastener. The releasable fastener may be snap-on cartridges having male/female attachment points on the utility head 307 and the lateral portion of the terminal elbow. Alternatively, the releasable fastener may be a hook and loop fastener (e.g., VELCRO), snaps, or the like. The adjustable handle 304 includes a non-slip, safety grip such as a tape, friction fabric, foam, or combination thereof.

The present disclosure describes a novel multifunctional back tool that allows a user to cleanse, scratch, massage, moisturize, or heat treat the user's back while maintaining a comfortable position of the user's arms without straining the shoulder of the user. Moreover, the rotatable utility head allows for flexibility in accessing hard-to-reach portions of the user's back and leverage for the user in performing conformal cleansing and/or application processes.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the Figures. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application. For example, the heat recovery heat exchangers may be further optimized.

The invention claimed is:

1. A personal care product comprising:

an elbow having:

a first end extending in a first direction; and a second end extending in a second direction that is non-parallel to the first direction;

a handle coupled to the first end of the elbow such that the handle extends in the first direction;

an arm coupled to the second end of the elbow such that the arm extends in the second direction, wherein the arm is selectively extendable from the second end of the elbow;

a first personal care attachment detachably coupled to the arm; and a second personal care attachment interchangeable with the first personal care attachment;

wherein the first personal care attachment and the second personal care attachment detachably couple to the arm via a coupler including at least one of a nut/bolt configuration, a magnet, a hook and look fastener, threading, adhesive tape, suction cups, snap-on cartridges, or sliding grooves.

2. The personal care product of claim 1, wherein the handle is selectively extendable from the first end of the elbow.

3. The personal care product of claim 2, further comprising a first detent configured to selectively engage one of a plurality of first apertures of the handle to lock the handle to the elbow in one of a plurality of discrete positions.

4. The personal care product of claim 1, further comprising a second detent configured to selectively engage one of a plurality of second apertures of the arm to lock the arm to the elbow in one of a plurality of discrete positions.

5. The personal care product of claim 1, wherein the first direction is substantially perpendicular to the second direction.

6. The personal care product of claim 1, wherein the first personal care attachment is selected from a group consisting of a scratcher attachment, a washcloth, a lotion applicator, or a bath pouf.

7. The personal care product of claim 1, wherein the second personal care attachment is different than the first personal care attachment.

8. The personal care product of claim 1, further comprising a second elbow having:

a third end coupled to an end of the arm opposite the first elbow; and a fourth end extending in a third direction that is non-parallel to the second direction;

wherein at least one of the first personal care attachment or the second personal care attachment couple to the fourth end of the second elbow.

9. The personal care product of claim 8, wherein the third direction is substantially perpendicular to the second direction.

10. The personal care product of claim 8, wherein the first direction and the third direction are the same.

11. The personal care product of claim 8, wherein the second elbow is detachably coupled to the arm.

12. The personal care product of claim 8, wherein the first personal care attachment and the second personal care attachment detachably couple to the fourth end of the second elbow.

13. The personal care product of claim 8, wherein the first personal care attachment is fixed to the fourth end of the second elbow, further comprising a third elbow interchangeable with the second elbow, wherein the second personal care attachment is fixed to the third elbow.

14. A personal care product comprising:

a first elbow having:

a first end extending in a first direction; and a second end extending in a second direction that is non-parallel to the first direction;

a handle coupled to the first end of the first elbow such that the handle extends in the first direction;

an arm coupled to the second end of the first elbow such that the arm extends in the second direction;

a second elbow detachably coupled to the arm, the second elbow having:

a third end coupled to an end of the arm opposite the first elbow; and a fourth end extending in a third direction that is non-parallel to the second direction; and an attachment coupled to the fourth end of the second elbow.

15. The personal care product of claim 14, wherein at least one of (i) the handle is selectively extendable from the first end of the first elbow or (ii) the arm is selectively extendable from the second end of the first elbow.

16. The personal care product of claim 14, wherein the attachment is detachably coupled to the second elbow.

17. A personal care product comprising:

an elbow having a first end and a second end;

a handle coupled to the first end of the elbow such that the handle extends in a first direction;

an arm coupled to the second end of the elbow such that the arm extends in a second direction, the arm terminating with a joint;

an attachment coupled to the joint, wherein the attachment is selectively pivotable relative to the arm about the joint, and wherein the joint and the attachment form a ball-cup socket; and at least one of:

a first locking mechanism positioned to selectively lock the handle to the elbow in a desired position; or a second locking mechanism positioned to selectively lock the arm to the elbow in a desired position;

wherein the at least one of the first locking mechanism or the second locking mechanism includes a detent configured to selectively engage one of a plurality of apertures of the handle or the arm, respectively, to lock the handle or the arm to the elbow in one of a plurality of discrete positions.

* * * * *